US012091998B2

(12) United States Patent
Strähle et al.

(10) Patent No.: US 12,091,998 B2
(45) Date of Patent: Sep. 17, 2024

(54) MUFFLER

(71) Applicant: Purem GmbH, Neunkirchen (DE)

(72) Inventors: Martin Strähle, Wendlingen (DE); Michaela Weber, Wendlingen (DE); Jonathan Lang, Stuttgart (DE); Lukas Te-Kaat, Stuttgart (DE); Marco Jess, Esslingen (DE); Frank Sühnel, Wernau (DE); Markus Schmitt, Merchweiler (DE); Matthias Scheer, Oberthal (DE); Harald Gerlich, Schiffweiler (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/872,817

(22) Filed: Jul. 25, 2022

(65) Prior Publication Data

US 2023/0024144 A1 Jan. 26, 2023

(30) Foreign Application Priority Data

Jul. 26, 2021 (DE) ..... 10 2021 119 216.1

(51) Int. Cl.
*F01N 1/02* (2006.01)
*F01N 13/14* (2010.01)
*F01N 13/18* (2010.01)

(52) U.S. Cl.
CPC ..... *F01N 1/023* (2013.01); *F01N 13/14* (2013.01); *F01N 13/1888* (2013.01); (Continued)

(58) Field of Classification Search
CPC ..... F01N 1/023; F01N 13/14; F01N 13/1888; F01N 2470/02; F01N 2470/18
See application file for complete search history.

(56) References Cited

U.S. PATENT DOCUMENTS 4,598,790 A 7/1986 Uesugi et al.
5,859,394 A 1/1999 Seehaus et al.
(Continued)

FOREIGN PATENT DOCUMENTS

CN 106121798 A 11/2016
CN 211038778 U 7/2020
(Continued)

OTHER PUBLICATIONS

English translation of first Chinese Office action dated Jul. 15, 2024 for corresponding Chinese patent application 202210874646.7.

*Primary Examiner* — Jeremy A Luks
(74) *Attorney, Agent, or Firm* — Walter Ottesen, P.A.

(57) ABSTRACT

A muffler for an exhaust gas system of an internal combustion engine. The muffler has a muffler housing having at least two interconnected housing shells delimiting a muffler interior. Each housing shell has a connecting edge extending away from the muffler interior. The housing shells are mutually connected by material bonding in the region of their mutually adjacent housing shell connecting edges. An insulating arrangement covers at least regions of the inner side of one of the housing shells. The insulating arrangement has an insulating shell with an insulating shell connecting edge extending away from the muffler interior and the insulating shell is arranged with the insulating shell connecting edge between the mutually adjacent connecting edges of the housing shells and is connected by material bonding to the connecting edges of the housing shells in the region of the insulating shell connecting edge.

11 Claims, 2 Drawing Sheets

(52) U.S. Cl.
CPC ..... *F01N 2470/02* (2013.01); *F01N 2470/18* (2013.01); *F01N 2490/15* (2013.01)

(56) References Cited

U.S. PATENT DOCUMENTS

| | | | | | |
|---|---|---|---|---|---|
| 5,907,135 | A | | 5/1999 | Hayakawa et al. | |
| 6,158,214 | A | * | 12/2000 | Kempka | F01N 1/023 181/227 |
| 6,668,972 | B2 | * | 12/2003 | Huff | F01N 1/10 181/282 |
| 6,789,644 | B2 | * | 9/2004 | Mukaida | F01N 1/089 181/275 |
| 7,273,129 | B2 | * | 9/2007 | Harwood | F01N 13/14 181/282 |
| 2008/0127639 | A1 | | 6/2008 | Kellermann | |
| 2015/0300235 | A1 | | 10/2015 | Wegener et al. | |

FOREIGN PATENT DOCUMENTS

| | | | | | |
|---|---|---|---|---|---|
| EP | 1 512 852 | A2 | | 3/2005 | |
| EP | 2314834 | A1 | * | 4/2011 | F01N 1/02 |
| FR | 1 244 433 | A | | 10/1960 | |
| JP | H06-221147 | A | | 8/1994 | |
| JP | H08312326 | A | | 11/1996 | |
| JP | H10-24381 | A | | 1/1998 | |

* cited by examiner

MUFFLER

CROSS REFERENCE TO RELATED APPLICATION

This application claims priority of German patent application no. 10 2021 119 216.1, filed Jul. 26, 2021, the entire content of which is incorporated herein by reference.

TECHNICAL FIELD

The present disclosure relates to a muffler for an exhaust gas system of an internal combustion engine.

BACKGROUND

EP 1 512 852 B1 discloses a muffler for an exhaust gas system of an internal combustion engine and muffler housing thereof which is constructed with two housing shells formed by shaping sheet-metal material. The two housing shells each have a curved shell body and a housing shell circumferential edge which projects outwardly therefrom and which has a bearing surface. The housing shell circumferential edges of the two housing shells are positioned opposite one another, with the interposition of an inner plate which subdivides the interior of the muffler housing into two chambers, and are connected to one another by laser welding. The inner plate forms, together with one of the housing shells, an inlet region via which exhaust gas flows into one of the chambers. The inner plate forms, together with the other of the two housing shells, an outlet region via which exhaust gas exits the other of the two chambers. The two chambers are connected to one another via a plurality of openings formed in the inner plate.

Into that one of the two chambers into which the exhaust gas enters via the inlet region there is inserted a layer of a thermal insulation made of high-density fiber material that covers the inner surface of the housing shells outwardly delimiting this chamber. The thermal insulation can be coated on at least one side with a foil made of stainless steel. Furthermore, fiber material having a lower fiber density than that of the thermal insulation is accommodated in the chamber which is thermally insulated by the thermal insulation with respect to the housing shell delimiting the chamber.

SUMMARY

It is an object of the present disclosure to provide a muffler for an exhaust gas system of an internal combustion engine that allows thermal insulation of a muffler housing while being configured in a structurally simple and easy-to-produce manner.

According to the disclosure, this object is achieved by a muffler for an exhaust gas system of an internal combustion engine, including a muffler housing having at least two interconnected housing shells delimiting a muffler interior, wherein each housing shell has a housing shell connecting edge extending in a direction away from the muffler interior, and the housing shells are connected to one another by material bonding in the region of their mutually oppositely arranged housing shell connecting edges, and wherein an insulating arrangement covering an inner side of at least one of the housing shells, at least in certain regions, is provided in the muffler interior.

This muffler is characterized in that the insulating arrangement has at least one insulating shell with an insulating shell connecting edge extending in a direction away from the muffler interior, and in that the at least one insulating shell is arranged with its insulating shell connecting edge between the mutually oppositely arranged housing shell connecting edges of the housing shells and is connected by material bonding to the housing shell connecting edges of the housing shells in the region of the insulating shell connecting edge.

In the case of the muffler constructed according to the disclosure, the use of at least three components which have a shell-like construction and are to be connected to one another, namely the housing shells and the insulating shell, ensure that a stable structure to be produced in a simple and cost-effective manner is achieved in which the fixed connection of three components of shell-like construction, which connection is in particular also tight with respect to the exit of exhaust gas, is produced by material bonding involving these three components. Further measures are not required for integrating a thermal insulation for at least one of the two housing shells delimiting the muffler interior.

The material bonding connecting the insulating shell connecting edge to the housing shell connecting edges of the housing shells may include a weld seam which runs, preferably substantially without interruption, along the housing shell connecting edges and the insulating shell connecting edge. The fixed connection of the three components of the muffler that have a shell-like construction is achieved with this single three-body seam, for example in a single welding operation.

To provide a sufficiently large volume of the muffler interior, at least the at least one of the housing shells, preferably each housing shell, may include a curved housing shell body which is surrounded by the housing shell connecting edge thereof and which delimits the muffler interior, and the at least one insulating shell may include a curved insulating shell body surrounded by the insulating shell connecting edge thereof.

To avoid impact noises and to provide good thermal insulation, it is proposed that the insulating shell body and the housing shell body of the at least one of the housing shells are arranged at a distance from one another. A gap-like interspace, which, with the gas accumulating therein, provides an insulating layer, is therefore formed between the insulating shell body and the housing shell body of the at least one of the housing shells. It should be pointed out that, while maintaining such an interspace, the insulating shell body and the housing shell body of the at least one of the housing shells can bear against one another locally, for example in the region of formations provided thereon, in order to achieve defined mutual support. These shell bodies can be fixedly connected to one another in such regions, for example by welding.

An embodiment which can be produced in a simple and cost-effective manner and which in particular is particularly suitable for carrying out a welding operation can be provided by virtue of the housing shells and the insulating shell being provided by shaped sheet-metal parts.

For defined flow guidance in the muffler interior, an exhaust gas flow volume can be formed between the insulating shell and one of the housing shells, wherein the exhaust gas flow volume is subdivided into a plurality of chambers by at least one intermediate wall. Here, at least one intermediate wall can be held clamped in between the insulating shell and at least one of the housing shells. In this way, no additional measures are required to hold such an intermediate wall in the muffler interior in a predetermined installation position. Furthermore, the clamping in of one or more such intermediate walls also ensures defined bracing of the insulating shell with respect to the housing shells, with the result that the occurrence of vibration excitations, in particular of the insulating shell, which lead to noise or damage in the muffler can be practically ruled out.

In order to be able to set a defined noise-damping behaviour in the muffler, it is proposed that the at least one insulating shell extends from a longitudinal end region of the muffler housing up to an intermediate wall and covers the at least one of the housing shells on the inner side thereof in a region extending between the one longitudinal end region of the muffler housing and the intermediate wall, and that, in a region extending between the intermediate wall and the other longitudinal end region of the muffler housing, the at least one of the housing shells is not covered on the inner side thereof by the at least one insulating shell. Furthermore, there can be provision for this purpose that a chamber which is at least partially filled with noise-damping material is formed between the intermediate wall and the other longitudinal end region of the muffler housing.

To introduce exhaust gas into the muffler and to discharge exhaust gas from the muffler, at least one exhaust gas inlet pipe open to the muffler interior and at least one exhaust gas outlet pipe open to the muffler interior can be provided. In order to achieve a fixed connection of these pipes to the muffler housing, it is proposed that at least one pipe of the exhaust gas inlet pipe and exhaust gas outlet pipe is connected, preferably by material bonding, to the muffler housing in the region of a pipe-receiving opening formed between the insulating shell connecting edge and the housing shell connecting edge of one of the housing shells and/or at least one pipe of the exhaust gas inlet pipe and exhaust gas outlet pipe is connected, preferably by material bonding, to the muffler housing in the region of a pipe-receiving opening formed between the housing shell connecting edges of two housing shells.

The disclosure further relates to an exhaust gas system for an internal combustion engine, in particular in a motor vehicle, including at least one muffler as described above.

BRIEF DESCRIPTION OF THE DRAWINGS

The invention will now be described with reference to the drawings wherein.

DESCRIPTION OF THE PREFERRED EMBODIMENTS

Figure 1:
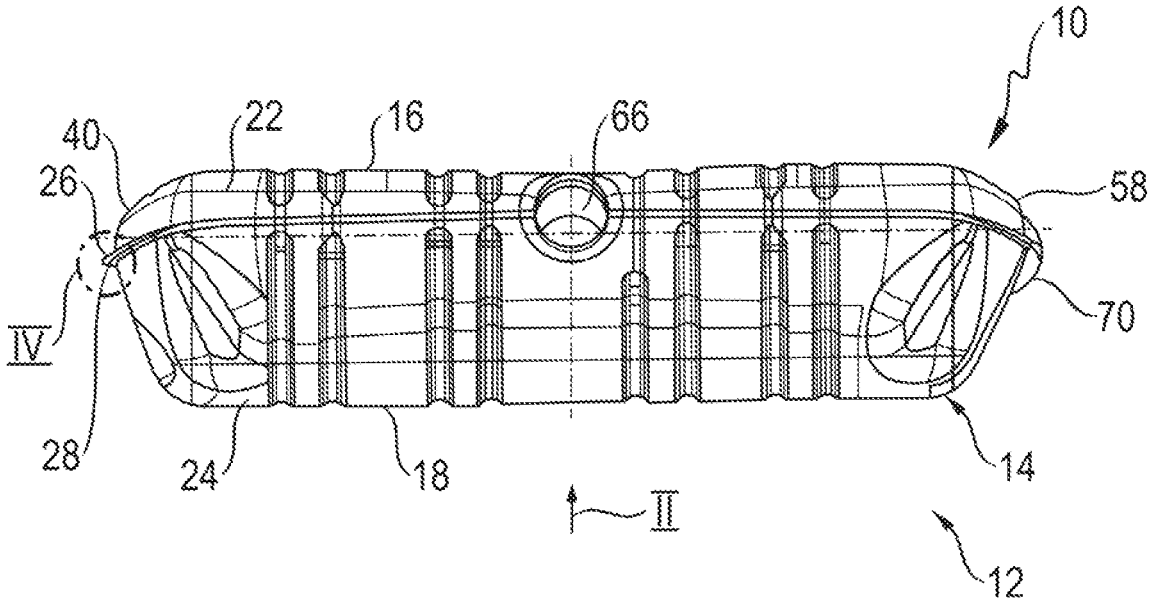
FIG. 1 shows a side view of a muffler for an exhaust gas system in a motor vehicle.
Figure 2:
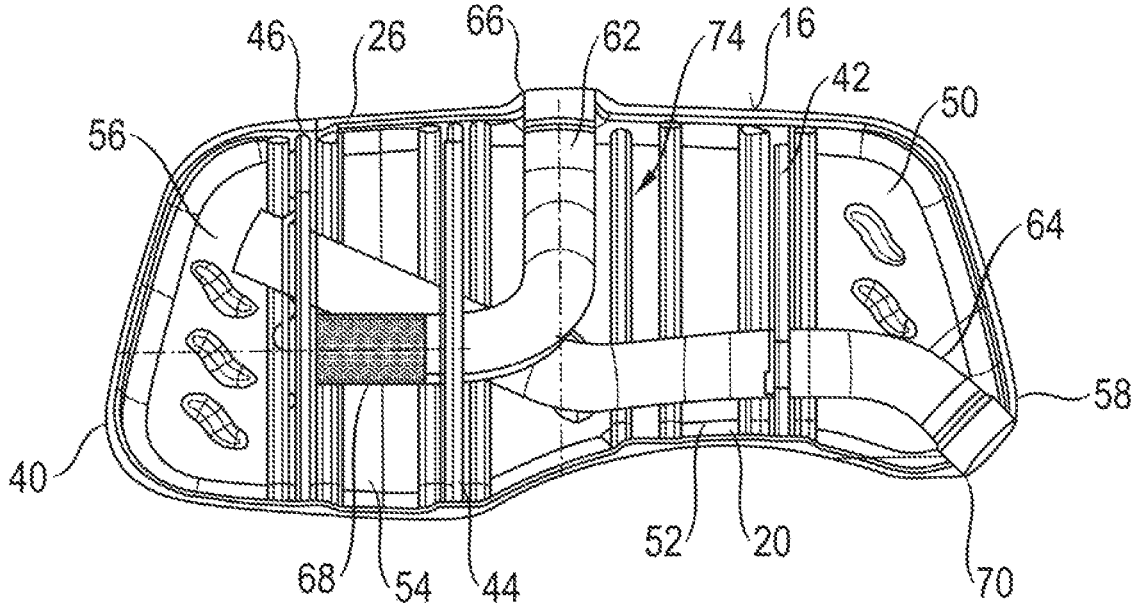
FIG. 2 shows a plan view of the muffler of FIG. 1 in viewing direction II with the upper housing shell removed.
Figure 3:
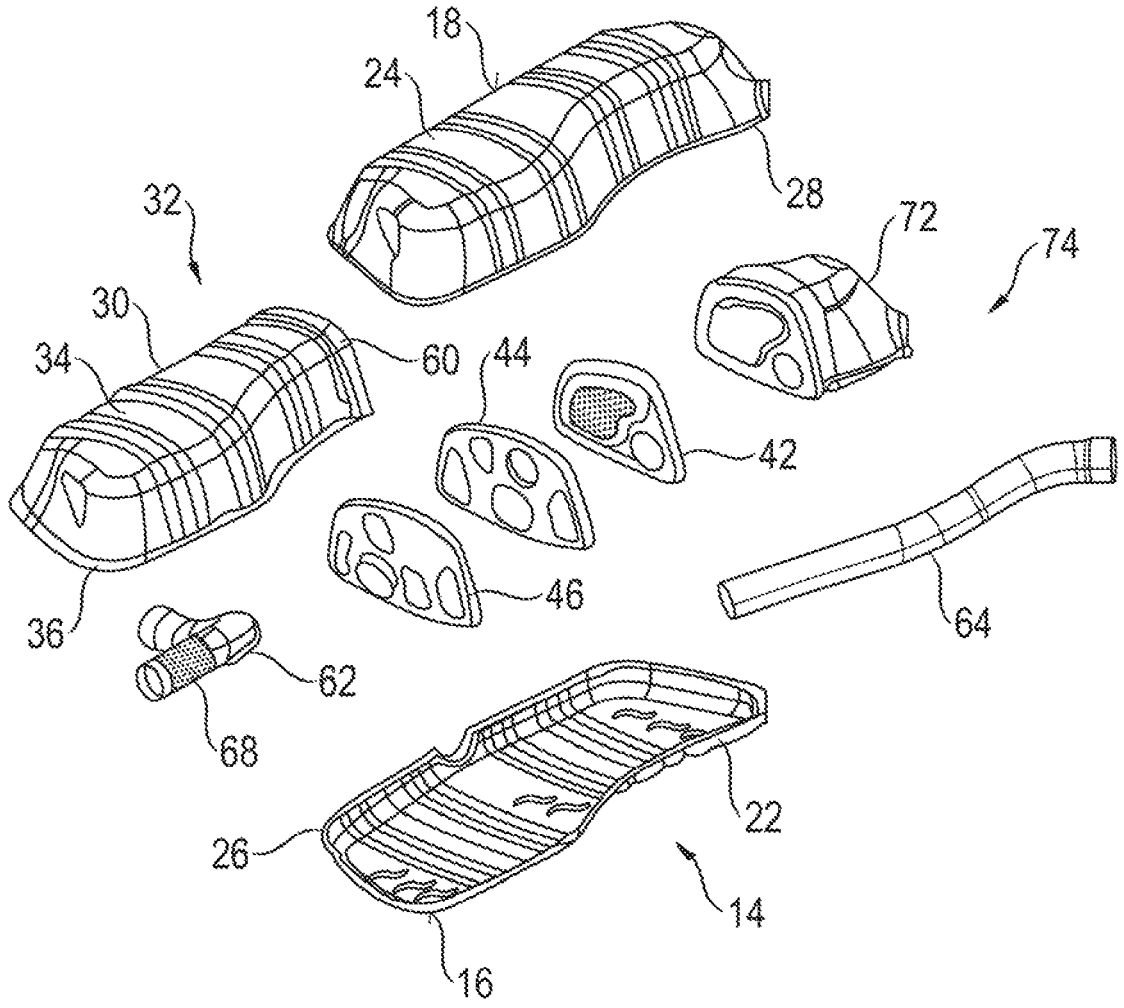
FIG. 3 shows an exploded illustration of the muffler of FIG. 1.
Figure 4:
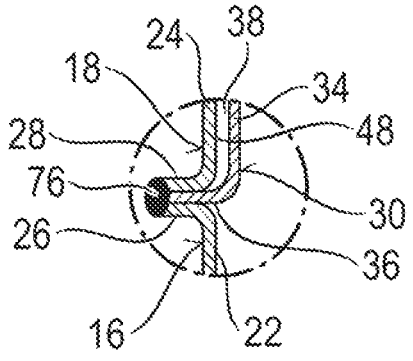
FIG. 4 shows an enlarged illustration of the detail IV in FIG. 1, which illustrates the connection of the two housing shells of the muffler of FIG. 1 to an insulating shell.

FIGS. 1 and 3 show a muffler, generally designated by 10, for an exhaust gas system 12 of an internal combustion engine in a vehicle. The muffler 10 includes a muffler housing 14 having a housing shell 16 and a housing shell 18. Each of the housing shells 16, 18 provided as shaped sheet-metal parts has a housing shell body 22, 24 which is curved outwardly with respect to a muffler interior 20 delimited by the housing shells 16, 18. Each housing shell body 22, 24 is surrounded by a housing shell connecting edge 26, 28 extending outwardly with respect to the muffler interior 20. The two housing shells 16, 18 are situated opposite one another by way of their housing shell connecting edges 26, 28 and are connected in the region of the housing shell connecting edges 26, 28 in the manner described below.

An insulating arrangement 32 provided by an insulating shell 30 formed as a shaped sheet-metal part is provided in the muffler interior 20 delimited by the two housing shells 16, 18. The insulating shell 30 has a curved insulating shell body 34 and an insulating shell connecting edge 36 surrounding the latter. The insulating shell connecting edge 36 also extends outwardly with respect to the muffler interior 20 and in the assembled state lies between the housing shell connecting edges 26, 28.

It can be seen in FIG. 3 that the insulating shell body 30 is adapted in terms of its curvature to the curvature of the housing shell 18. In the assembled state, the insulating shell body 34 of the insulating shell 30, which is adapted in its shaping substantially to the shaping of the curved housing shell body 24 of the housing shell 18, is situated at a distance from the housing shell body 24, with the insulating shell connecting edge 36 being positioned between the housing shell connecting edges 26, 28, with the result that a gap-like interspace 38 is formed between the insulating shell body 34 and the housing shell body 24.

The insulating shell 30 extends in the muffler interior 20 delimited by the housing shells 16, 18 from a first longitudinal end region 40 of the muffler housing 14 up to one of three intermediate walls 42, 44, 46 arranged in the muffler interior 20. In the region situated between the first longitudinal end region 40 of the muffler housing 14 and the intermediate wall 42, the insulating shell 30 covers an inner side 48 of the housing shell 18 while maintaining the interspace 38.

The muffler interior 20 is subdivided into four chambers 50, 52, 54, 56 by the intermediate walls 42, 44, 46. The chamber 50 extends substantially between the intermediate wall 42 and a second longitudinal end region 58 of the muffler housing 14. The chamber 52 lies substantially between the two intermediate walls 42, 44. The chamber 54 lies substantially between the two intermediate walls 44, 46, and the chamber 56 extends substantially between the intermediate wall 46 and the first longitudinal end region 40 of the muffler housing 14. The chambers 50, 52, 54, 56 are connected to one another by openings provided in the intermediate walls 42, 44, 46.

The intermediate walls 44, 46 are situated in that region in which the insulating shell 30 covers the inner side 48 of the housing shell 18. As a result, direct contact between the intermediate walls 44, 46 and the housing shell 18 is not possible. The intermediate walls 44, 46 are therefore held between the insulating shell 30 and the housing shell 16. For this purpose, inwardly projecting rib-like formations which are assigned to one another in pairs can be formed on the insulating shell 30 on the one hand and the housing shell 16 on the other hand, between which formations the intermediate walls 44, 46 are fixedly held and are thus clamped in between the insulating shell 30 and the housing shell 16 in all movement directions.

The intermediate wall 42 can be positioned in such a way that it adjoins the insulating shell 30 in a direction from the first longitudinal end region 40 to the second longitudinal end region 58 of the muffler housing 14 and thus is held between the housing shells 16, 18 in the region of inwardly projecting rib-like formations provided thereon so as to be assigned to one another in pairs. In order to avoid noises possibly occurring as a result of mutual abutment, a gap-like interspace can be formed between the end region 60, which is situated close to the intermediate wall 42, of the insulating shell 30 and the intermediate wall 42. It should be pointed out that, alternatively, the intermediate wall 42 could also be held between the housing shell 16 and the insulating shell 30 if, for example, two inwardly projecting rib-like formations are also provided on the insulating shell 30 so as to be assigned to the intermediate wall 42, with the formations receiving the latter therebetween.

The muffler 10 further includes an inlet pipe 62 and an outlet pipe 64. The inlet pipe 62 leads, in the region of a pipe-receiving opening 66 formed on the muffler housing 14, into the muffler interior 20 and passes through the intermediate walls 44, 46. In its length region situated between the intermediate walls 44, 46, the inlet pipe 62 has perforations 68 via which the inlet pipe 62 is open to the chamber 54. At its end situated in the muffler interior 20, the inlet pipe 62 is open to the chamber 56.

The outlet pipe 64 leads, in the region of a pipe-receiving opening 70, into the muffler interior 20 and passes through the intermediate walls 42, 44, 46. In the region of the chamber 56, the outlet pipe 64 is open to the chamber 56 at its end situated in the muffler interior 20.

In its length region passing through the chamber 50, the outlet pipe 64 extends through noise-damping material 72 arranged in the chamber 50. This material can be block-like in form and be built up with foamed or fiber-like material. Alternatively, the noise-damping material 72 could also take the form of cladding which, without covering the whole volume or substantially the whole volume of the chamber 50, covers the housing shells 16, 18 in the region of the chamber 50 on the respective inner side thereof.

The pipe-receiving opening 66 for the inlet pipe 62 is situated in that region of the muffler housing 14 in which the insulating shell 30 covers the housing shell 18 on its inner side 48. Therefore, the pipe-receiving opening 66 is formed substantially between the housing shell connecting edge 26 of the housing shell 16 and the insulating shell connecting edge 36 of the insulating shell 30.

Whereas the pipe-receiving opening 66 for the inlet pipe 62 is positioned substantially centrally between the two longitudinal end regions 40, 58 of the muffler housing 14, the pipe-receiving opening 70 for the outlet pipe 64 is provided at the second longitudinal end region 58 of the muffler housing 14 and is therefore situated in a region in which the housing shell 18 is not covered by the insulating shell 30 and therefore the insulating shell connecting edge 36 is not positioned between the housing shell connecting edges 26, 28. The pipe-receiving opening 70 for the outlet pipe 64 is therefore formed between the housing shell connecting edges 26, 28 of the housing shells 16, 18.

When assembling the muffler 10, there can first of all be constructed a muffler insert 74 which includes the intermediate walls 42, 44, 46, the noise-damping material 72, the inlet pipe 62 passing through the intermediate walls 44, 46, and the outlet pipe 64 passing through the noise-damping material 72 and the intermediate walls 42, 44, 46. To produce a fixed connection, it is possible, for example, for the inlet pipe 62 and the outlet pipe 64 to be connected to the intermediate walls 42, 44, 46 through which they pass by material bonding, for example welding, and/or by a press fit. This muffler insert 74 can then for example be inserted into that one of the housing shells 16, 18 which is not covered on its inner side by the insulating shell 30. In the example illustrated, this is the housing shell 16. After positioning the muffler insert 74 for example in the housing shell 16, first of all the insulating shell 30 can be placed on the muffler insert 74 such that it has its insulating shell connecting edge 36 cover the housing shell connecting edge 26 of the housing shell 16 in certain regions and, together with the housing shell connecting edge 26, has its insulating shell connecting edge 36 surround the inlet pipe 62 in the region of the pipe-receiving opening 66.

In a subsequent work step, the other housing shell, that is, the housing shell 18 in the illustrated embodiment, can be placed such that it covers the insulating shell 30 or the housing shell 16 and the muffler insert 74 already positioned on the housing shell 16. In this state, the housing shell connecting edge 28 of the housing shell 18 lies on the insulating shell connecting edge 36 in that region in which the insulating shell 30 has its insulating shell connecting edge 36 covering the housing shell connecting edge 26 of the housing shell 16 and lies directly opposite or on the housing shell connecting edge 26 of the housing shell 16 in that region in which the housing shell connecting edge 26 is not covered by the insulating shell connecting edge 36. In order to avoid the occurrence of a gap-like interspace in this region, it is possible for there to be formed, in at least one of the housing shells 16, 18 in the region of the housing shell connecting edge 26, 28 thereof, a step-like transition to a set-back region of the respective housing shell connecting edge in order to produce sufficient receiving space for the insulating shell connecting edge 36 in that region in which the insulating shell connecting edge 36 is to be positioned between the housing shell connecting edges 26, 28.

After the housing shell 18 has been placed, the outlet pipe 64 is held in the region of the pipe-receiving opening 70 between the housing shell connecting edges 26, 28 of the housing shells 16, 18, and the intermediate walls 42, 44, 46 are held between the insulating shell 30 and the housing shell 16 or between the housing shell 18 and the housing shell 16.

In a subsequent operation, the housing shell connecting edges 26, 28 receiving the insulating shell connecting edge 36 therebetween in certain regions can be connected to one another by material bonding, preferably welding. For this purpose, a weld seam 76, which preferably runs around in the circumferential direction, is formed in order to obtain a gastight closure. Furthermore, the inlet pipe 62 and the outlet pipe 64, in the regions thereof respectively situated in the pipe-receiving openings 66 and 70, are connected to the connecting edges surrounding the regions by material bonding, preferably welding. Here, too, a weld seam which in each case completely runs around along the respective pipe-receiving opening 66, 70 can be formed in order to obtain a gastight closure. In the region of the pipe-receiving opening 66 where the pipe-receiving opening 66 is delimited by the insulating shell connecting edge 36, there is at the same time also produced a connection between the insulating shell connecting edge 36 and the housing shell connecting edge 28, which is adapted to the shaping thereof, of the housing shell 18.

In the case of the above-described construction of a muffler, regional thermal insulation of one of the housing shells is achieved by the arrangement of the insulating shell in the muffler interior delimited by the housing shells, with only the insertion of a shaped sheet-metal part being required for this purpose. The gap-like interspace formed between the insulating shell and the housing shell covered by the latter in certain regions ensures thermal insulation to the outside without additional structural measures being required.

It should finally be pointed out that of course the above-described muffler can be configured differently in various aspects without departing from the principles of the present disclosure. Thus, for example, the insulating shell could cover one of the housing shells on the whole of its inner side. The insulating shell could be of multi-part configuration, and a respective insulating shell could be provided in association with both housing shells such that then two insulating shell connecting edges, which possibly bear against one another, are positioned between the housing shell connecting edges to be positioned opposite one another. Between the insulating shell and the housing shell covered on its inner side by the latter, there could be arranged insulating material, for example an insulating mat, that is, fiber material, in order to still further improve the thermal insulation.

It should further be pointed out that, for example, both pipes, that is, the inlet pipe and the outlet pipe, could be connected to the housing shells in a region in which at least one of the housing shells is covered by an insulating shell. Alternatively, both pipes could be connected to the muffler housing in a region in which none of the housing shells is covered by an insulating shell.

The muffler insert to be arranged in the muffler interior may be configured differently than shown in the illustrated embodiment. It could include more or fewer intermediate walls. Furthermore, the muffler insert could be constructed in such a way that a Helmholtz resonator is formed in the muffler interior, and a plurality of inlet pipes and/or a plurality of outlet pipes could be provided in order to introduce exhaust gas into the muffler or to discharge it from the muffler.

It is understood that the foregoing description is that of the preferred embodiments of the invention and that various changes and modifications may be made thereto without departing from the spirit and scope of the invention as defined in the appended claims.

What is claimed is:

1. A muffler for an exhaust gas system of an internal combustion engine, the muffler comprising:

a muffler housing including two mutually connected housing shells delimiting a muffler interior, said housing shells having respective connecting edges disposed so as to be mutually adjacent and extending in a direction away from said muffler interior, said housing shells being mutually connected by material bonding in the region of said mutually adjacent connecting edges;

at least one exhaust gas inlet pipe open to said muffler interior;

at least one exhaust gas outlet pipe open to said muffler interior;

an insulating arrangement disposed in said muffler interior covering an inner side of one of said housing shells at least at regions thereof, said insulating arrangement including at least one insulating shell having an insulating shell connecting edge extending in a direction away from said muffler interior, said at least one insulating shell being arranged so as to cause said insulating shell connecting edge to be disposed between said mutually adjacent connecting edges of said housing shells, such that an exhaust gas flow volume is formed between said at least one insulating shell and an other one of said housing shells, said insulating shell being connected via material bonding to said mutually adjacent connecting edges in a region of said insulating shell connecting edge;

at least one intermediate wall subdividing said exhaust gas flow volume into a plurality of chambers, at least one intermediate wall of said at least one intermediate wall being held clamped between said at least one insulating shell and said other one of said housing shells; and, a first pipe-receiving opening formed between said insulating shell connecting edge and the housing shell connecting edge of said other one of said housing shells, one of said exhaust gas inlet pipe and said exhaust gas outlet pipe being connected to said muffler housing in the region of said first pipe-receiving opening.

2. The muffler of claim 1, wherein said material bonding comprises a weld seam running along said mutually adjacent connecting edges and said connecting edge of said at least one insulating shell.

3. The muffler of claim 2, wherein said weld seam runs without interruption along said mutually adjacent connecting edges and said connecting edge of said at least one insulating shell.

4. The muffler of claim 1, wherein said one of said housing shells includes a curved housing shell body surrounded by the housing shell connecting edge corresponding thereto and delimiting said muffler interior; and, said at least one insulating shell includes a curved insulating shell body surrounded by said insulating shell connecting edge thereof.

5. The muffler of claim 4, wherein said insulating shell body and said shell body of said one of said housing shells are arranged at a distance from one another.

6. The muffler of claim 4, wherein said housing shells and said insulating shell are configured as respective sheet-metal parts.

7. The muffler of claim 1, wherein said at least one insulating shell extends from a first longitudinal end region of said muffler housing up to one intermediate wall of said one intermediate wall and covers said at least one of said housing shells on said inner side thereof in a region extending between said first longitudinal end region of said muffler housing and to said one intermediate wall of said at least one intermediate wall; and, said at least one insulating shell is configured so as to leave said inner side of said at least one housing shell uncovered thereby in a region between said one intermediate wall of said at least one intermediate wall and a second longitudinal end region of said muffler housing.

8. The muffler of claim 7, wherein one of said chambers is formed between said one intermediate wall of said at least one intermediate wall and said second longitudinal end region of said muffler housing;

and, said one of said chambers is at least partially filled with noise-damping material.

9. The muffler of claim 1, further comprising:

a second pipe-receiving opening formed between said housing shell connecting edges of said housing shells;

wherein an other one of said exhaust gas inlet pipe and said exhaust gas outlet pipe is connected to said muffler housing in the region of said second pipe-receiving opening.

10. The muffler of claim 9, wherein the connection of said pipes at corresponding ones of said first and second pipe-receiving openings is via material bonding.

11. An exhaust gas system for an internal combustion engine, the exhaust gas system comprising:

a muffler including:

a muffler housing including two mutually connected housing shells delimiting a muffler interior, said housing shells having respective connecting edges disposed so as to be mutually adjacent and extending in a direction away from said muffler interior, said housing shells being mutually connected by material bonding in the region of said mutually adjacent connecting edges;

at least one exhaust gas inlet pipe open to said muffler interior;

at least one exhaust gas outlet pipe open to said muffler interior;

an insulating arrangement disposed in said muffler interior covering an inner side of one of said housing shells at least at regions thereof, said insulating arrangement including at least one insulating shell having an insulating shell connecting edge extending in a direction away from said muffler interior, said at least one insulating shell being arranged so as to cause said insulating shell connecting edge to be disposed between said mutually adjacent connecting edges of said housing shells, such that an exhaust gas flow volume is formed between said at least one insulating shell and an other one of said housing shells, said insulating shell being connected via material bonding to said mutually adjacent connecting edges in a region of said insulating shell connecting edge;

at least one intermediate wall subdividing said exhaust gas flow volume into a plurality of chambers, at least one intermediate wall of said at least one intermediate wall being held clamped between said at least one insulating shell and said other one of said housing shells; and, a first pipe-receiving opening formed between said insulating shell connecting edge and the housing shell connecting edge of said other one of said housing shells, one of said exhaust gas inlet pipe and said exhaust gas outlet pipe being connected to said muffler housing in the region of said first pipe-receiving opening.

* * * * *